United States Patent [19]

Gargioni

[11] Patent Number: 4,568,194

[45] Date of Patent: Feb. 4, 1986

[54] MIXING APPARATUS FOR MIXING PAINT COMPOSITIONS AND THE LIKE SLURRY PRODUCTS

[76] Inventor: Domenico Gargioni, Piazza Bonomelli, 4, 20100 - Milano, Italy

[21] Appl. No.: 484,147

[22] Filed: Apr. 11, 1983

[30] Foreign Application Priority Data

Apr. 27, 1982 [IT] Italy ..... 21696/82[U]

[51] Int. Cl.[4] ..... B01F 9/02

[52] U.S. Cl. ..... 366/213; 366/601; 366/605

[58] Field of Search ..... 366/DIG. 605, 208, 217, 366/219, 232, 211, 212, 233, 220, 214, 213, 601, 605

[56] References Cited

U.S. PATENT DOCUMENTS 3,187,524 6/1965 Wolverton ..... 68/139

3,212,302 10/1965 Gruner ..... 68/12 R

*Primary Examiner*—Philip R. Coe

*Assistant Examiner*—Frankie L. Stinson

*Attorney, Agent, or Firm*—Bucknam and Archer

[57] ABSTRACT

The apparatus comprises a revolving cage (4) provided with two plates (20,21) effective to be rotated about the central axis whereof and to receive and hold a product vessel to be processed (33), and two electric motors (13,17) effective to rotate, individually and with a different transmission ratio, the cage driving pulley (10), the operation of either one or the other motor depending on the height of the product vessel (33) with respect to a threshold height.

6 Claims, 4 Drawing Figures

2

24
6
1
8
18
23
4
24
5
19
7
3
33
8

31
7
19
23
5
32
22
21
29
30
8
24

MIXING APPARATUS FOR MIXING PAINT COMPOSITIONS AND THE LIKE SLURRY PRODUCTS

The present invention relates to a mixing apparatus, particularly effective for mixing suspension or slurry products, such as paints and the like, as contained in vessels, before the use thereof.

As it is known, the present trend of the paint or the like slurry product makers, is that of supplying their products with a minimum of main colours, or even supplying a base product devoid of any pigments, in order to reduce to a minimum the inventory of the products to be held in the store, and separately selling the pigment or colouring material, in such a way as to afford to the buyer the possibility of preparing the desired tint for the supplied product.

To this end, small mixing apparatus have been designed, effective to provide the component materials with a satisfactory homogenization before the selling, with respect to the desired tint and colour, which operation has been heretofore carried out manually by the user.

The mentioned mixers use, for the mixing operation, that same vessel wherein there is contained the base product and operate on the principle of subjecting said base product, after adding thereto the desired pigment or colouring material, to a contemporaneous mouvement in two directions which are mutually perpendicular, that is about the longitudinal axis of the vessel and about an axis perpendicular to said longitudinal axis, in order to evenly homogenize the desired product.

More specifically, the presently commercially available mixers are provided with a rotating cage, provided with two rotating plates, effective to support the product vessel and to be positionally adjusted in order to fit different size product vessels.

The mentioned cage is rotated by a motor, in order to cause the product vessel to rotate about the perpendicular axis to the mentioned vessel longitudinal axis, whereas the plates are kinematically rotated through the rotation of the cage.

Since the mixing centrifugal force is given by the formula $F=M\omega^2r$ and is accordingly a function of the product specific mass, of the squared angular velocity or speed and the vessel radius and supposing, by a first approximation, that the mass be constant for a given vessel, then the rotation speed of the vessel about its axis will vary in a reversely proportional way with respect to the diameter and height of said product vessel.

This means that the presently commercially available mixers, wherein the rotation of the vessel about its axis is derived from that of the cage, are not suitable for mixing products contained in vessels of comparatively different size, from the can to the drum, since the peripheral speeds of said vessels, being equal to the rotation speed of the cage, vary with respect to one another in such a degree as to cause the vessels to be broken.

Mixers have been constructed wherein it is possible to vary, either in a discrete or in a continuous way the vessel rotation speed about the longitudinal axis, but those apparatus have a poor operative reliability.

In fact, in the mixers wherein the speed may be changed in a continuous way, that variation is generally obtained by means of a trapezoidal belt transmission, of reduced power capability.

Thus, as the size of the vessel to be rotated is a large one, a slipping phenomenon occurs between the operative members of the speed variator, whereby the mixing apparatus loses its usefulness.

On the other hand, in the mixers wherein the rotation speed may be varied in a discrete way, there is the possibility of selecting an erroneous rotation speed, which, on the contrary, has to be accurately selected depending on the size of the vessel to be stirred, with the consequent possibility of rotating with an excessive speed the large vessels or with an insufficient speed the small ones.

Accordingly, the task of the present invention is to overcome the thereinabove mentioned drawbacks by providing such a mixing apparatus wherein it is possible to achieve two different rotation speeds, respectively for vessels having a height up to a determined limit and vessels of greater height.

Within that task, a main object of the present invention is to provide such a mixing apparatus which is effective to automatically assume either one or the other rotation speed, depending on the height of the vessel to be stirred or processed.

Another object of the present invention is to provide such a mixing apparatus which is constructionally simple and strong and of high operative reliability.

According to one aspect of the present invention, the thereinabove mentioned task and objects, as well as yet other objects which will become more apparent thereinafter are achieved by a mixing apparatus, comprising a cage effective to be rotated about the transversal axis thereof, provided with two plates effective to be rotated about the central axis thereof, and to receive and hold the product vessel, said plates including means for causing said plates to be moved nearer with respect to one another or away from one another, said cage being rotated through a driven pulley which is rigid therewith, while said plates are rotated through a belt passing on a fixed pulley and slidable on transmission pulleys, one of the latter being rigid with the shaft of said vessel rotating plate, characterized in that it includes two motors effective to rotate, individually and with a different transmission ratio, said driven pulley, the operation of either one or the other of said motors depending on the height of said product vessel, as compared with respect to a determined threshold height.

Advantageously, on the shafts of the mentioned motors there are respectively mounted a pulley, of suitable diameter, and two different diameter further pulleys, the larger whereof is controlled, through a respective belt, by said individual pulley, whereas the smaller whereof is coupled, by means of a further belt, to the driven pulley.

Moreover, the alternative energizing of either one or the other motor is controlled by a photocell system, operating an electronic relay, the impinging light beam whereof, having a horizontal axis, is either shut off or not by the product vessel as clamped between the two rotating plates.

Further characteristics and advantages of the miwing apparatus according to the present invention will become more apparent hereinafter from the following detailed description of a typical embodiment thereof, being illustrated, by way of an indicative example, in the figures of the accompanying drawings, where:

Figure 1:
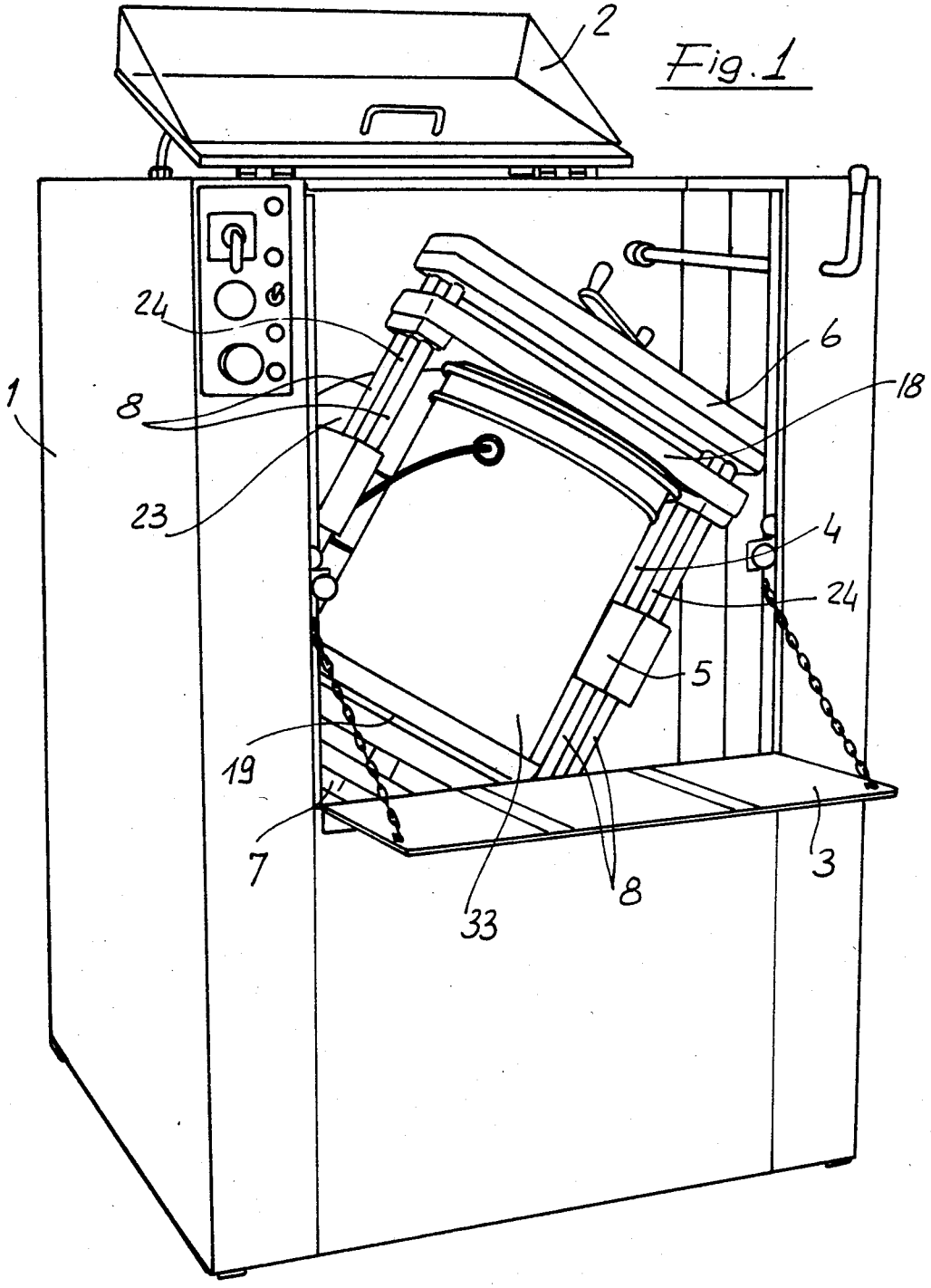
FIG. 1 is a perspective view illustrating the mixing apparatus according to the present invention, the two rotating plates whereof are shown in the condition wherein they clamp therebetween a large sized product vessel.
Figure 2:
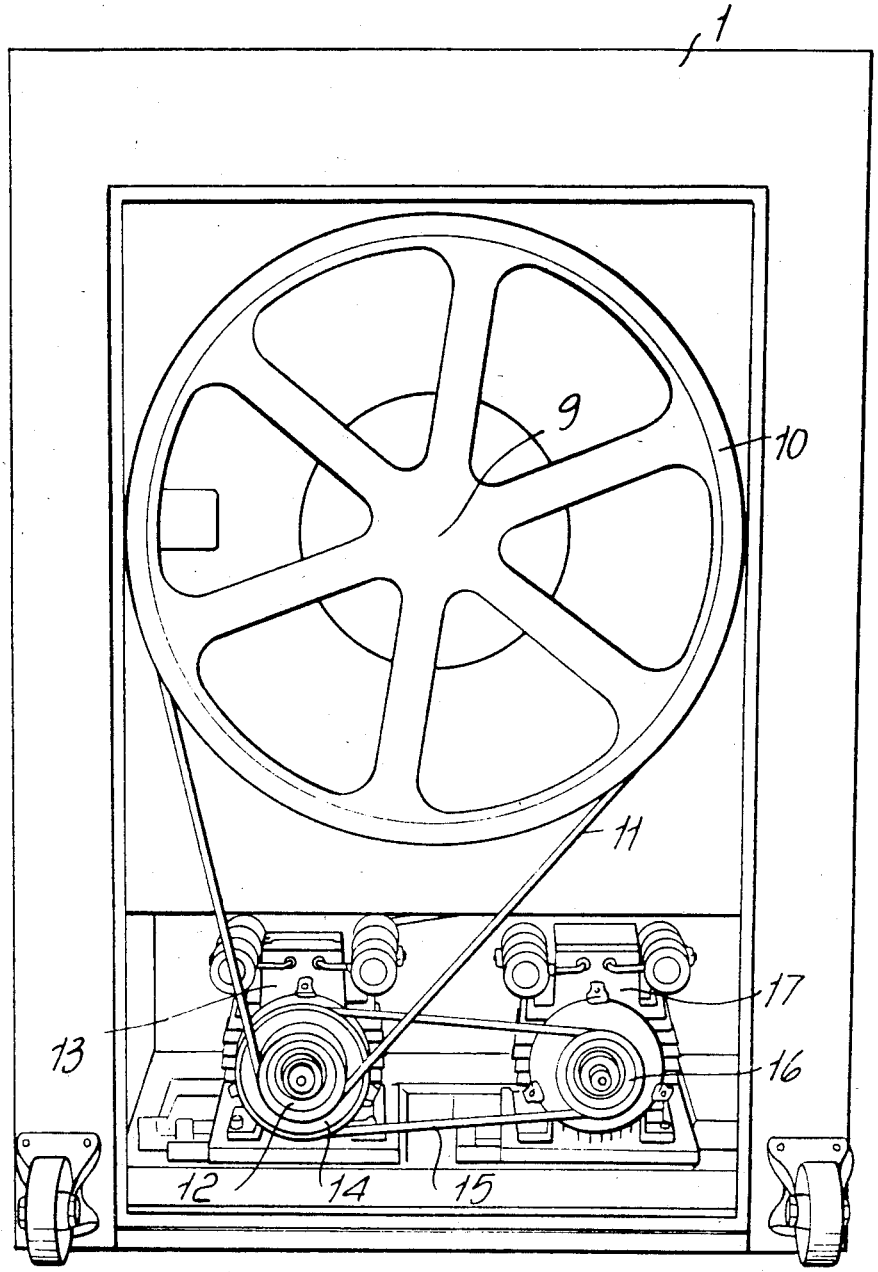
FIG. 2 is a rear view of that same mixing apparatus.
Figure 3:
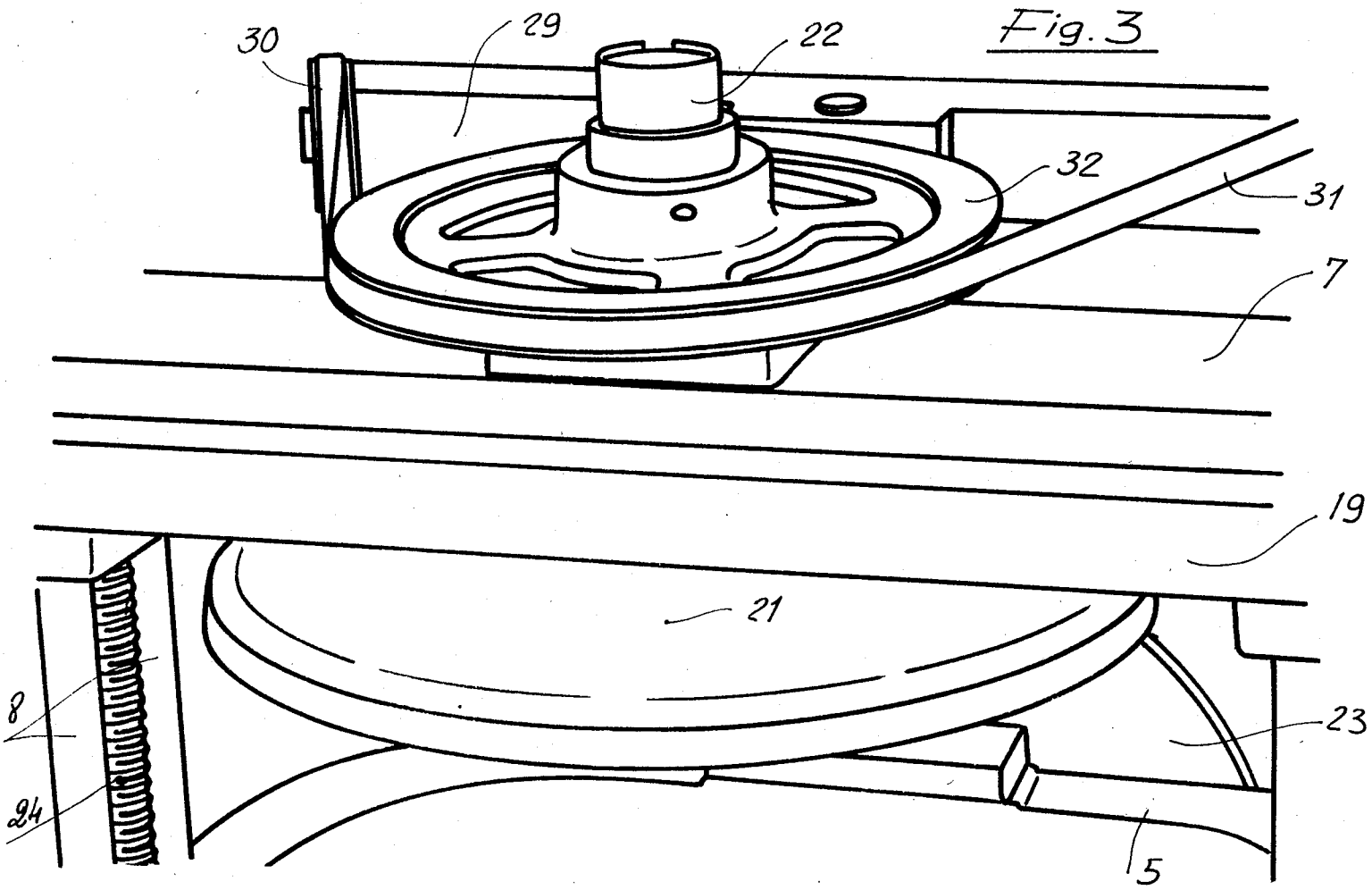
FIG. 3 illustrates a plate as directly rotated by the rotating cage.
Figure 4:
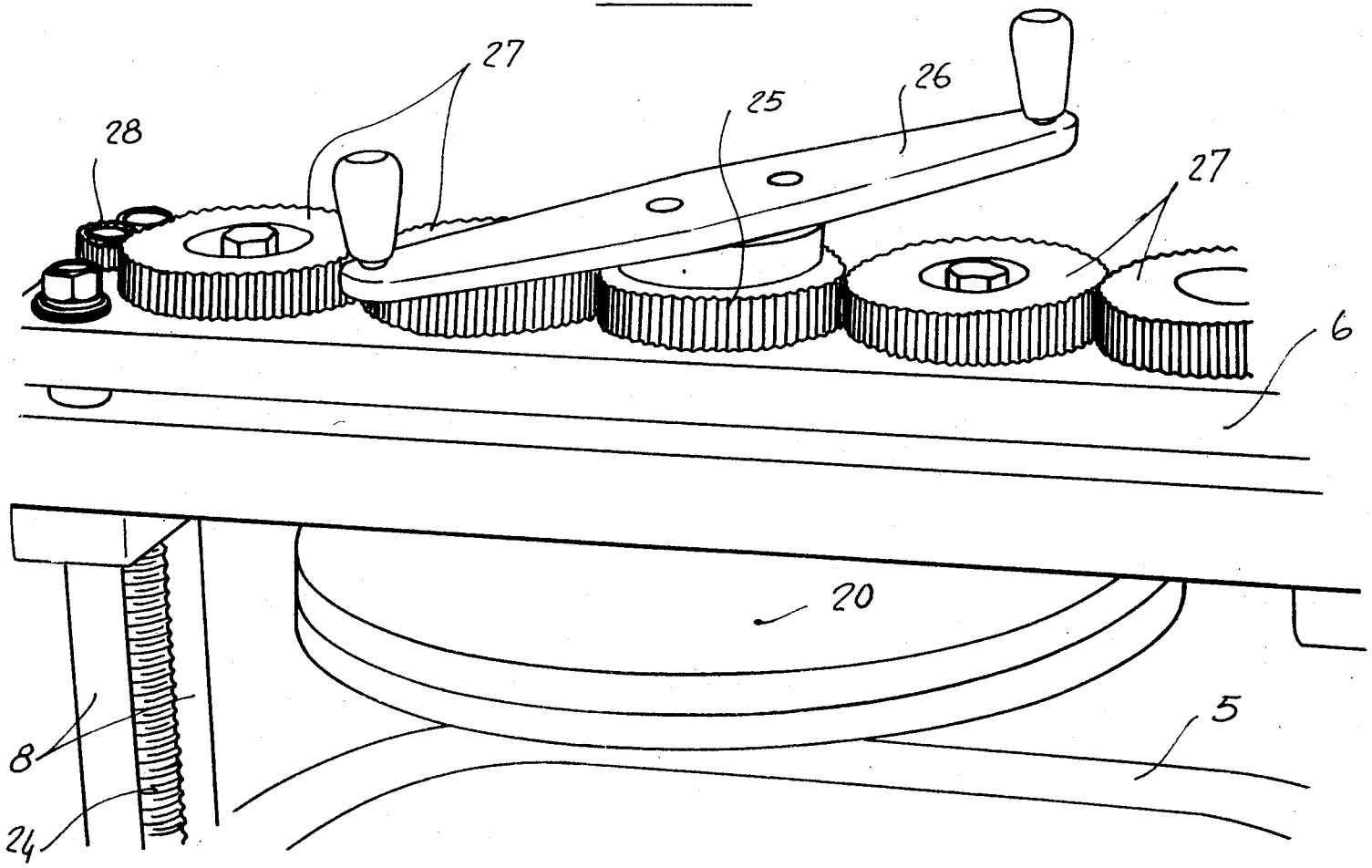
FIG. 4 illustrates the device for controlling the approaching and separating movements of the vessel clamping plates.

With reference to the number references of the figures of the accompanying drawings, the mixing apparatus according to the present invention comprises an outer envelope or casing 1, provided with a cover 2 and front door 3 and designed for carrying out the mixing operation in a closed environment, due to safety reasons.

The mixer proper consists of a cage 4, provided with a central bracket 5, a top plate 6, a bottom plate 7, coupled to one another, at their respective ends, by means of two small columns 8.

More specifically, the bracket 5 is provided with a shaft 9, coupled to a large diameter pulley 10, effective to be rotated, through a flexible driving member 11, by a first pulley 12, keyed on the shaft of a first motor 13.

On that same shaft there is keyed a further pulley 14, of suitably greater diameter than the first pulley, and coupled, through a further flexible driving member 15, to a pulley 16, which latter is keyed on the shaft of a further motor 17.

Above and under the mentioned bracket 5, there are provided two movable plates 18 and 19 effective to slide along the column or pillar members 8 each whereof respectively bears a rotating plate 20 and 21, one whereof, (the plate 20), is idly mounted on its plate, whereas the other has its shaft 22 supported in bearings as provided in said plates 7 and 19.

Behind the cage 4, there is provided a large pulley 23 which is fixedly mounted on the mentioned casing 1.

In particular, the movable plates 18 and 19 are moved in such a way as to approach one another or to be separated from one another by means of two threaded rods 24, each whereof is arranged between a column 8 pair, said rods having opposite pitch threads at the lower and upper portions of the bracket 5 of the cage 4.

Thus, by rotating the threaded rods 24, the two plates 18,19 and accordingly the two plates 20 and 21 may be moved towards one another or away from one another.

The mentioned threaded rods are rotated by means of a gear wheel 25, pivoted on the plate 6 and provided with a driving arm 26, which meshes with a gear pair 27, the latter being engaged with corresponding sprockets 28 fixed at one end of the threaded rods.

The plate 7 of the cage 4 bears, cantilever wise, a cross-member 29 provided, at the ends whereof, with horizontal axis pulleys 30, thereon is effective to slide the belt 31, of the mentioned large fixed pulley, 23, passing through the pulley 32 mounted on the shaft 22.

Thus, by rotating the cage 4 by means of one of the motors 13 or 17, the pulley 32 is caused to roll along the belt 31, in such a way as to drive the plate 21 and consequently the product vessel 33, which is clamped between said plate 21 and the plate 20.

In particular, on one of the vertical walls of the casing 1 there is located, at a suitable height, a light source, preferably of the LED type (not shown), effective to emit a horizontal axis light beam (either visible or not).

The mentioned light beam will impinge on a photodiode or photoresistor or phototransistor, arranged on the other wall of the casing 1, and controlling a relay, of the electronic type, effective to selectively energize either one or the other electric motor.

Thus, as the light beam is not shut off by the vessel 33, as the latter has a small height, will be automatically energized the electric motor 13, in such a way as to rotate the cage 4 with a great speed.

On the contrary, as the product vessel has such a size as to shut off said light beam, will be automatically energized the electric motor 17 which, because of the reducing ratio between the pulleys 12 and 14 will cause the rotation or revolving speed of the cage, and accordingly of the plates 20 and 21, to be reduced.

It should be noted that the mixing apparatus according to the present invention has the further and important feature of being provided with two plates 20 and 21 effective to be moved towards one another or separated from one another, in a contemporaneous and like way.

Due to that feature, the plates 20 and 21 afford the possibility of precisely centering the vessels, independently from the height and size whereof.

Thus the mixing apparatus according to the present invention will be able of rotating and revolving the product vessels without subjecting the latter to eccentric or offset movements susceptible to stir the paint products in a disordered and not homogeneous way.

From the above disclosure and the figures of the accompanying drawings, it should be apparent that a slurry product mixing apparatus has been provided which is highly improved with respect to the commercially available mixing apparatus, since it affords the possibility of adjusting the revolving speed of a product vessel about its axis in a fully automatic way, whereby the mixing operation will be a truly efficient one, independently from the size of the processed vessel.

It should further be noted that the paint mixing apparatus according to the invention is susceptible to several modifications and variations all whereof falling within the scope of the invention as it is defined in the accompanying claims.

I claim:

1. A mixing apparatus having a cage rotatable about its transversal axis, said cage including two plates rotatable about their central axes and adapted to receive and hold a product vessel therebetween, said plates including means for causing said plates to be selectively moved nearer with respect to one another and away from one another, a driven pulley rigid with said cage, said cage being rotated via said driven pulley, a fixed pulley, a belt passing on said fixed pulley, said plates being rotated via said belt passing on said fixed pulley and transmission pulleys on which said belt is slidable, said vessel rotating plate having a shaft, one of said transmission pulleys being rigid with said shaft of said vessel rotating plate, said mixing apparatus comprising two motors for rotating, individually and each with a different transmission ratio, said driven pulley, each of said motors having a shaft, the operation of one of said motors depending on the height of said product vessel with respect to a determined threshold height;

a given diameter pulley;

two additional pulleys of different diameters, said given diameter pulley and said additional pulleys being respectively mounted on said shafts of said motors;

a belt on said given diameter pulley, the pulley of greater diameter of said pulleys of different diameters being coupled to said belt;

an additional belt coupling the pulley of smaller diameter of said pulleys of different diameters to said driven pulley; and a photocell system for selectively energizing said motors, said photocell system comprising an electronic relay, an impinging light beam having a horizontal axis and a light detector controlling said relay, said light beam being blockable from impinging on said light detector by said product vessel, as clamped between said rotating plates.

2. A mixing apparatus as claimed in claim 1, wherein said cage has a central bracket, a top plate and a bottom plate, each of said plates having spaced opposite ends, and a pair of column members coupling said top and bottom plates to each other at the corresponding ends of said plates, said bracket having a shaft coupled to said driven pulley.

3. A mixing apparatus as claimed in claim 2, further comprising a pair of movable plates, one above said bracket and the other under said bracket, said plates being slidable along said column members, each of said movable plates bearing a corresponding one of said rotatable plates, one of said rotatable plates being idly mounted on the corresponding one of said movable plates and the other of said movable plates having bearings supporting the shaft of the other of said rotatable plates, which is said vessel rotating plate.

4. A mixing apparatus as claimed in claim 3, wherein each of said column members has two columns, and further comprising a pair of threaded rods each located between the columns of a corresponding one of said column members, each of said threaded rods having opposite pitch threads at the upper and lower parts of said bracket and selectively moving said movable plates toward and away from each other, said bracket being centrally positioned in said cage.

5. A mixing apparatus as claimed in claim 4, wherein each of said threaded rods has a sprocket keyed at a corresponding end thereof, and further comprising gear pairs engaging corresponding ones of said sprockets and a gear wheel meshing with said gear pairs for rotating said threaded rods, said gear wheel having a drive arm affixed thereto for rotating said gear wheel.

6. A mixing apparatus as claimed in claim 5, wherein said rotatable plates are movable toward and away from each other via said gear wheel, said gear pairs, said threaded rods and said movable plates.

* * * * *